US008215480B2

(12) United States Patent
Qian et al.

(10) Patent No.: US 8,215,480 B2
(45) Date of Patent: Jul. 10, 2012

(54) MICROTUBE CONTAINER AND CARRIER FOR MULTIPLE CONTAINERS

(75) Inventors: Mingwei Qian, Hockessin, DE (US); Haizhang Li, Orlando, FL (US)

(73) Assignee: Occam Biolabs, Inc., Newark, DE (US)

( * ) Notice: Subject to any disclaimer, the term of this patent is extended or adjusted under 35 U.S.C. 154(b) by 94 days.

(21) Appl. No.: 12/256,040

(22) Filed: Oct. 22, 2008

(65) Prior Publication Data

US 2009/0101539 A1 Apr. 23, 2009

Related U.S. Application Data

(60) Provisional application No. 60/999,691, filed on Oct. 22, 2007.

(51) Int. Cl.
*B65D 5/50* (2006.01)

(52) U.S. Cl. ..... 206/45.2; 206/45.23; 206/363; 206/446; 211/85.13

(58) Field of Classification Search ..... 206/446, 206/45.2, 45.23, 570, 438, 305, 363, 370, 206/486, 488; 211/85.13, 85.17
See application file for complete search history.

(56) References Cited

U.S. PATENT DOCUMENTS

| | | | | |
|---|---|---|---|---|
| 1,103,489 | A * | 7/1914 | Conover | 206/251 |
| 1,720,274 | A * | 7/1929 | Holden | 206/755 |
| 2,902,170 | A | 9/1959 | Miller et al. | |
| 3,233,804 | A * | 2/1966 | Dahm | 206/38 |
| 4,055,396 | A | 10/1977 | Meyer et al. | |
| 4,407,958 | A * | 10/1983 | DeGraff, Jr. | 211/74 |
| D273,985 | S | 5/1984 | Schulstad | |
| 4,453,639 | A | 6/1984 | Sharma | |
| 4,750,623 | A | 6/1988 | Flum | |
| 4,997,090 | A | 3/1991 | Lenmark, Sr. | |
| 5,006,066 | A | 4/1991 | Rouse | |
| 5,082,631 | A | 1/1992 | Lenmark, Sr. | |

(Continued)

FOREIGN PATENT DOCUMENTS

WO WO 2009/055438 A3 4/2009

OTHER PUBLICATIONS

Globe Scientific Inc., "Test Tube Racks," http://web.archive.org/web/20060709123548/www.globescientific.com/cpage40.html. 2 pages.

(Continued)

*Primary Examiner* — Steven A. Reynolds
*Assistant Examiner* — King M Chu
(74) *Attorney, Agent, or Firm* — RatnerPrestia

(57) ABSTRACT

A container for elongated objects, such as microtubes or vials, comprising a frame having a base and sides, a pair of rotatable opposing lid sections having at least two movement-resistant positions, and a rack with a plurality of holes or collars. The rack or interior bottom of the container may have features that discourage rotation of the microtubes or vials. The containers may further comprise microtubes or vials, which may be empty or filled with, for example, reagents, such as reagents for use in a predetermined process. A system of stackable carriers may be provided to hold and allow one-handed removal of a plurality of containers. The container may desirably permit one-handed opening and closing of the container and any vials contained therein, and the various lid positions may be suitable for submersion in an ice bath as well as standing upright on a laboratory bench.

27 Claims, 12 Drawing Sheets

U.S. PATENT DOCUMENTS

| | | | | |
|---|---|---|---|---|
| 5,108,287 | A | 4/1992 | Yee et al. | |
| 5,128,105 | A | 7/1992 | Berthold et al. | |
| 5,148,914 | A * | 9/1992 | Budert et al. | 206/1.5 |
| 5,285,907 | A | 2/1994 | Franchere et al. | |
| 5,312,250 | A | 5/1994 | Ellman et al. | |
| 5,318,753 | A | 6/1994 | Honda | |
| 5,570,784 | A * | 11/1996 | Sidabras et al. | 206/378 |
| 5,775,499 | A | 7/1998 | Budert | |
| 5,916,527 | A * | 6/1999 | Haswell | 422/104 |
| 6,024,218 | A | 2/2000 | Knoblauch | |
| 6,027,344 | A * | 2/2000 | Johanns et al. | 434/219 |
| 6,050,409 | A | 4/2000 | Delbeck et al. | |
| 6,066,300 | A | 5/2000 | Carey | |
| 6,123,205 | A * | 9/2000 | Dumitrescu et al. | 211/74 |
| 6,131,740 | A | 10/2000 | Huang | |
| 6,209,464 | B1 * | 4/2001 | Elder | 108/53.3 |
| 6,547,074 | B1 | 4/2003 | Chen | |
| 6,875,405 | B1 * | 4/2005 | Mathus et al. | 206/446 |
| 6,988,616 | B2 | 1/2006 | Chen | |
| 2005/0150808 | A1 | 7/2005 | Sarna et al. | |
| 2006/0042980 | A1 * | 3/2006 | Chen | 206/379 |
| 2007/0104617 | A1 | 5/2007 | Coulling | |

OTHER PUBLICATIONS

Globe Scientific Inc., "Screw Cap Test Tubes," http://web.archive.org/web/20060902130255/www.globescientific.com/Tubes/cpage41.html, 4 pages.

Globe Scientific Inc., "Cryovials (Sterile)," http://web.archive.org/web/20060902130345/www.globescientific.com/Tubes/cpage41-cryogenic.html, 1 page.

Simport, "Cryovial® Simport," http://web.archive.org/web/20061017094846/www.simpor.com/products/7/349/T315CRYO, 2 pages.

Simport, "Cryostore™ Storage Boxes," http://web.archive.org/web/20061017094813/www.simport.com/products/7/63/T314, 3 pages.

Simport, "T314-2100, T314-281, -481 & -581 and T314S," http//web.archive.org/web/20061017093348/www.simport.com/products/7/63, 2 pages.

Simport, "MICREWTUBE® with O-ring Seal and Flat Screw Cap," http://web.archive.org/web/20061017101852/www.simport.com/produits/6/74/T335, 3 pages.

Corning, "Corning® 1.2mL External Threaded Polypropylene Cryogenic Vial, Self-Standing with Conical Bottom (Product #430658)," http://web.archive.org/web/20070103002115/catalog2.corning.com/Lifesciences/productdetails, 3 pages.

Corning, "Cryogenic Vials, Plastic," http://web.archive.org/web/20060321042245/catalog2.corning.com/Lifesciences/category, 5 pages.

Corning, "Cyrogenic Storage Boxes for Vials," http://web.archive.org/web/20070711081831rn_1/catalog2.corning.com/Lifesciences, 1 page.

Axygen Scientific, "RA48 Microtube Storage AxyRack_series," http://web.archive.org/web/20061018144345/www.axygen.com/jsp/coreIdDetail, 1 page.

Axygen Scientific, "R81 Microtube Storage AxyRack_series," http://web.archive.org/web/20061018144349/www.axygen.com/jsp/coreIdDetail, 1 page.

Axygen Scientific, "SCT150SS Screw Cap Tube & Cap series. 1.5 mL," http://web.archive.org/web/20061018151329/www.axygen.com/jsp/coreIdDetail, 2 pages.

Axygen Scientific, "MCT060 Snaplock Microtube series. 0.6mL," http://web.archive.org/web/20061018144314/www.axygen.com/servlet/controller, 20 pages.

Eppendorf On-line Catalog, "It's your sample—Eppendorf consumables," www.eppendorf.com/worldwide, 60 pages.

Nalgene Labware, "5012 Bulk-packed Sterile Cryogenic Vials," http://web.archive.org/web/20061160842253/www.nalgenelabware.com/products, 2 pages.

Nalgene Labware, "5026 System 100™ CryoBox for 100 vials," http://web.archive.org/web/20061116083957/ www.nalgenelabware.com/products, 2 pages.

Nalgene Labware, "5026 System 100™ CryoBox for 100 vials," http://web.archive.org/web/20061116083949/www.nalgenelabware.com/products/productDetail, 2 pages.

Nalgene Labware, "5012 Bulk-packed Sterile Cryogenic Vials," http://web.archive.org/web/20060927092604/www.nalgenelabware.com/products/productDetail, 2 pages.

Nalgene Labware, "Product List—Cryoware," http://web.archive.org/web/20060827103844/www.nalgenelabware.com/products/productList, 8 pages.

International Search Report and Written Opinion dated May 28, 2009.

European Search Report for EP08840877 dated Aug. 9, 2011.

* cited by examiner

MICROTUBE CONTAINER AND CARRIER FOR MULTIPLE CONTAINERS

CROSS REFERENCE TO RELATED APPLICATIONS

This application claims priority of U.S. Provisional Application Ser. No. 60/999,691, titled "Holder and Package for Reagent Tubes", filed Oct. 22, 2007, incorporated herein by reference.

FIELD OF INVENTION

The present invention relates generally to containers for microtubes or vials, such as reagent tubes, and carriers or racks for multiple such containers, more specifically containers and associated container carriers for 0.5-5 ml screw cap microcentrifuge tubes or cryogenic storage vials, sample vials, screw cap microtubes, and/or micro storage tubes.

BACKGROUND OF THE INVENTION

Currently, although there are many types of tube containers and packages in use in laboratories or published in literature, there is still a need in the art for a tube container which allows one-hand operation for opening or closing screw cap microtubes and cryogenic vials, can be suspended in an ice bath as well as stood upright on a laboratory bench, is convenient for outdoor field use in sample collection, and that provides an efficiently organized, stabilized, and stackable arrangement for tube storage and transportation.

SUMMARY OF THE INVENTION

One embodiment of the invention comprises a container for elongated objects, such as for example, microtubes or cryogenic vials, with an open-top frame having a base, sides, and a pair of rotatable opposing lid sections are each attached to a side of the frame. The lid sections have at least two positions: a movement-resistant open position and a movement-resistant closed position. In the movement-resistant open position, the lid sections cooperate with the base to stabilize the container in a standing configuration. In the movement-resistant closed position the lid sections meet at the top of the container to form a completely enclosed container. The container comprises a rack mounted within the frame, the rack comprising a plurality of holes or collars that are designed to receive an intermediate portion of the elongated objects.

The lid sections may also have an intermediate movement-resistant position, in which the front and back faces of the lid are parallel to the base. The container may be sized to fit in the user's hand, and user may be able to move the lid sections between the open, intermediate, and closed positions by using one hand. The interior bottom of the container may have a plurality of bottom receptors for receiving corresponding bottom portions of microtubes or vials. To further aid one-handed operation, the bottom receptors, the rack, or both, may be equipped with features that discourage rotation of the microtubes or vials when housed in the container.

In some embodiments, the containers may further comprise microtubes or vials, each of which may be empty or filled with a substance, such as a reagent. In one embodiment, the container may comprise a kit for performing a predetermined procedure, in which case the microtubes or vials may contain sufficient amounts of the required reagents to perform the predetermined procedure.

Another embodiment of the invention comprises a system comprising the aforementioned containers and a carrier for storing one or more of the containers. The carrier comprises a base, opposite sides, and a plurality of container-holding sections each sized to accommodate one of the containers. In one embodiment, the base comprises a plurality of indentations or cutouts sized to permit a user's finger access to the underside of a respective container for one-handed removal of the container. In another embodiment, the carrier comprises a plurality of slides to house and permit one-handed removal of the containers. Side portions of the carrier may each have a slot on the top and a foot on the bottom sized such that when an upper carrier is stacked upon a lower carrier, the foot from the upper carrier interlocks with the slot on the lower carrier.

DETAILED DESCRIPTION OF THE INVENTION

Figure 1:
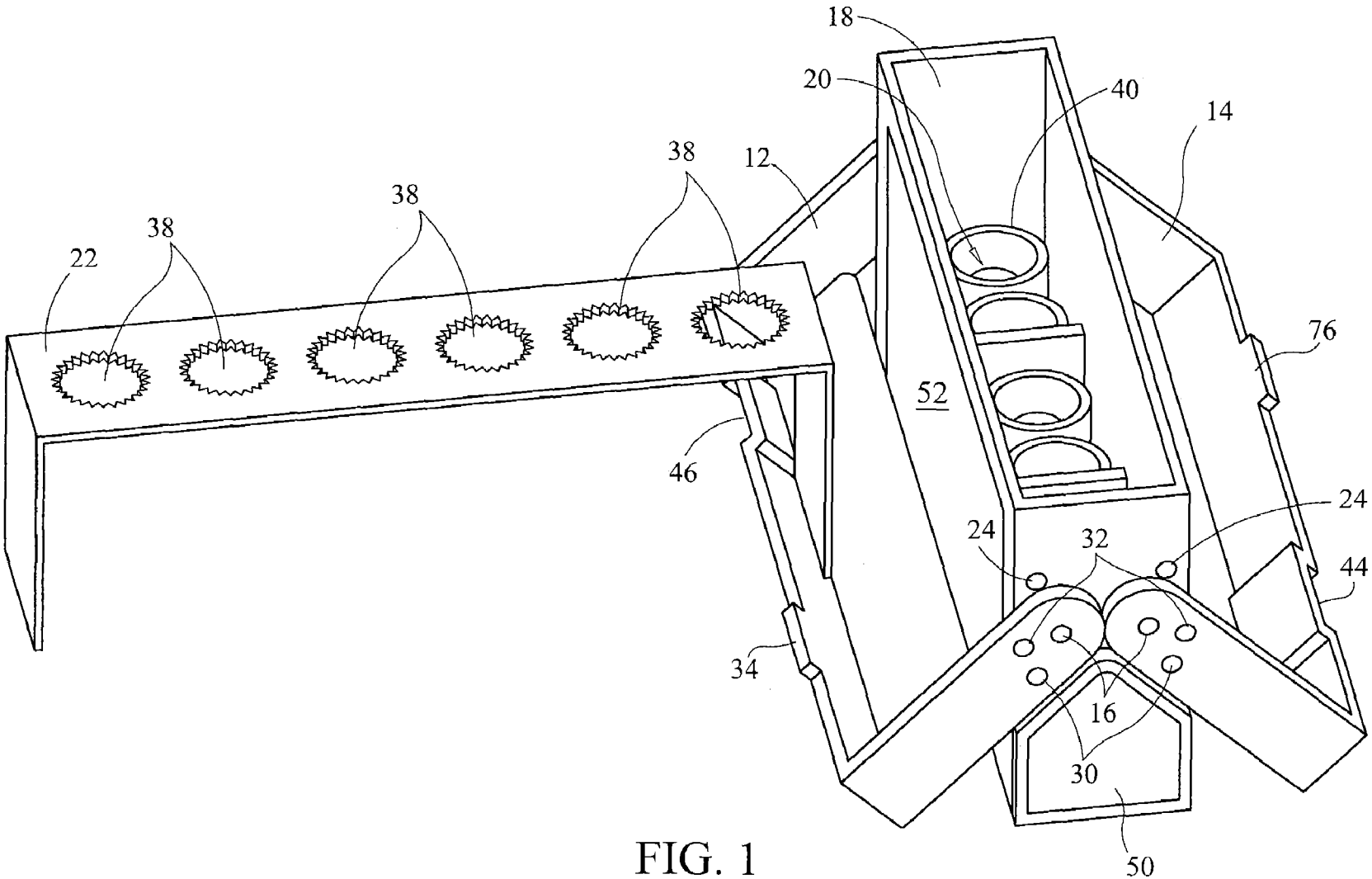
FIG. 1 is a perspective view of an exemplary tube container of the present invention, with the lid sections in a fully open position and the rack removed from the frame for illustrative purposes.

Although the invention is illustrated and described herein with reference to specific embodiments, the invention is not intended to be limited to the details shown. Rather, various modifications may be made in the details within the scope and range of equivalents of the claims and without departing from the invention.

The present invention will be further described based on embodiments as examples, but embodiments of this invention are not limited to these examples.

Referring now to the drawing, wherein like reference numerals refer to like elements throughout, FIGS. 1-9 depict an exemplary embodiment of container 10 of the present invention. Container 10 comprises a box frame 18 having a base plate 20, a rack 22 designed to fit securely inside the box frame 18, and two opposing lid sections 12, 14 attached by pins 16 to the box frame.

Figure 8:
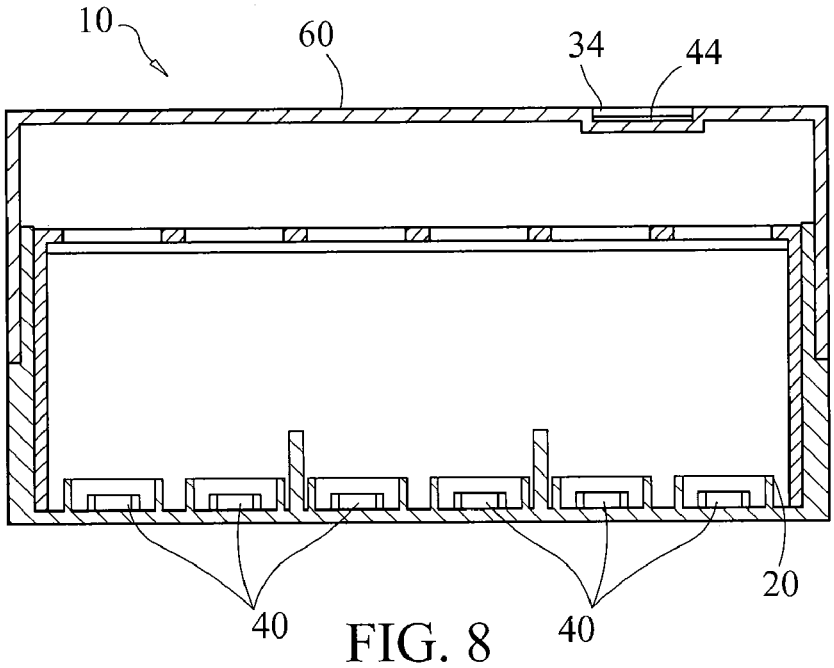
FIG. 8 is a cross-sectional view of the container of FIG. 1 along line A-A of FIG. 7.

Rack 22 has multiple holes 38 for holding multiple microtubes or cryogenic vials. Although shown here for use with microtubes of various designs, it should be understood that the present invention may be used with tubes or vials of any shape and size, or may be used for housing any type of elongated object. Base plate 20 may have receptors 40, as shown in FIG. 8, for receiving the respective bases of the inserted tubes. Holes 38 on the rack 22 and receptors 40 on the base plate 20 align with support tubes, such as exemplary tube 80 shown in FIG. 11A, inserted into container 10. Although shown as circular receptors 40 in FIG. 8, the receptors are not limited to any particular geometry, and may comprise any feature for interfacing with the bottoms of the tubes stored in the containers to keep the tubes in a desired location.

Figure 3:
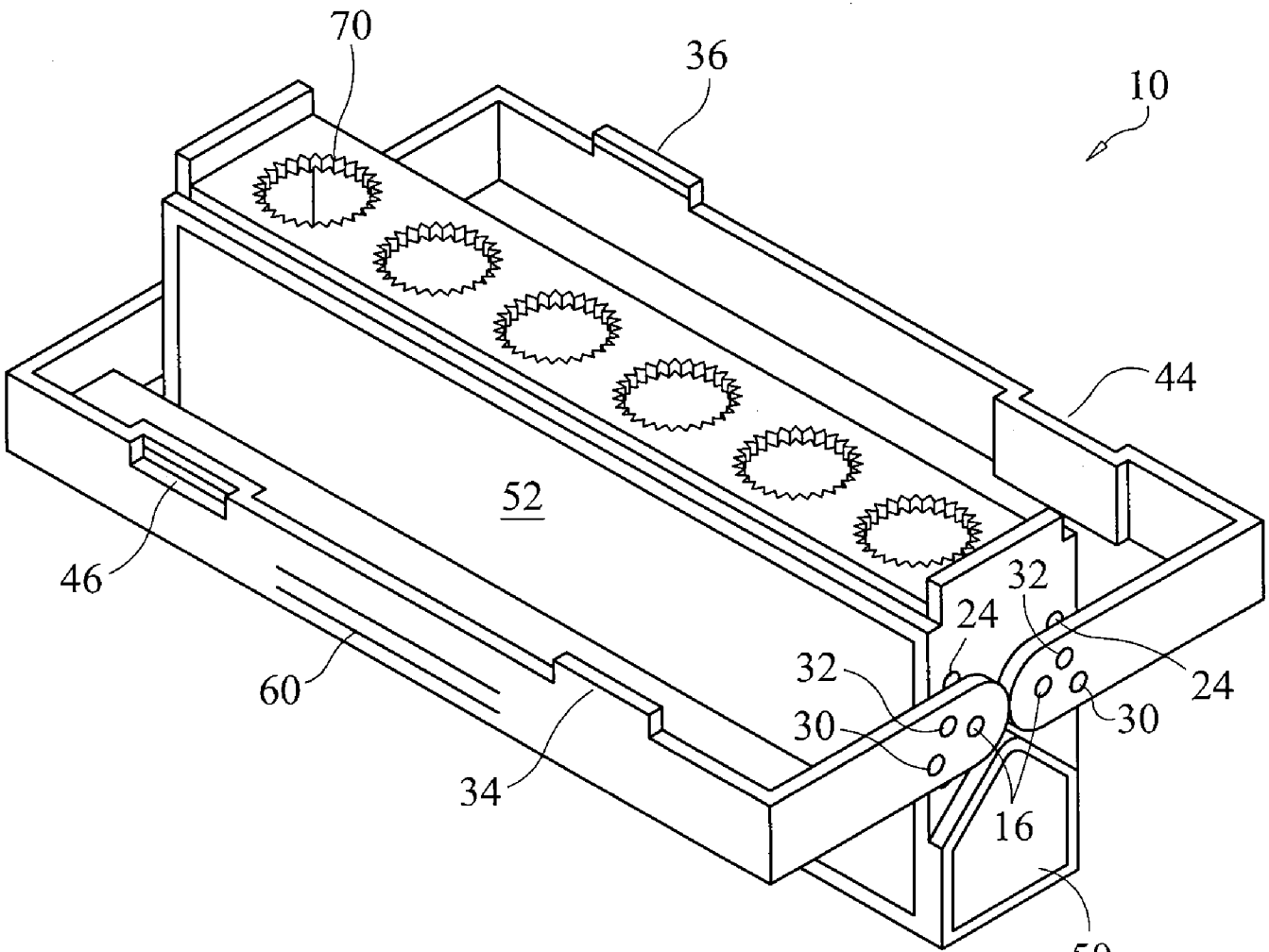
FIG. 3 is another perspective view of the container of FIG. 1 with the rack inserted and the two lid sections into the intermediate position in which the sides of the lid are parallel to the bottom surface of the package and perpendicular to the sides of the frame.
Figure 11A:
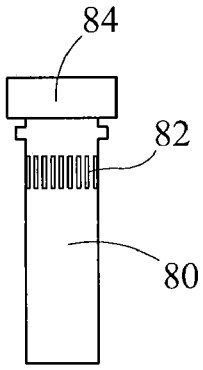
FIG. 11A is a side view of an exemplary microtube having a ridged neck section.
Figure 11B:
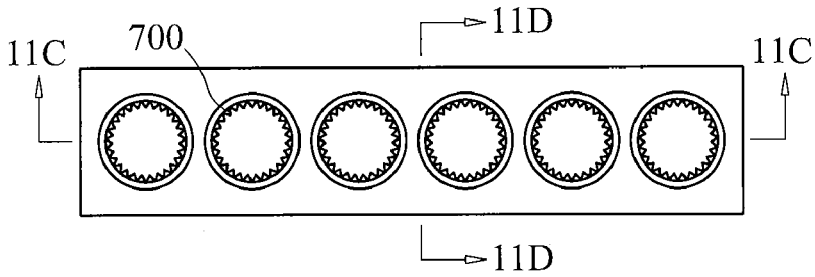
FIG. 11B is a top view of an exemplary rack with optional teeth or grooves to secure a ridged neck microtube.
Figure 12A:
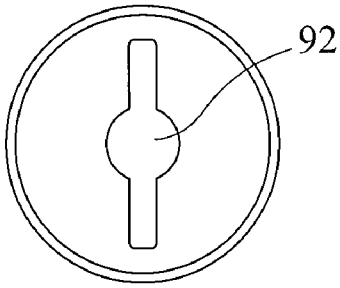
FIG. 12A is a bottom schematic view of an exemplary microtube having a slot base to prevent rotation.
Figure 12B:
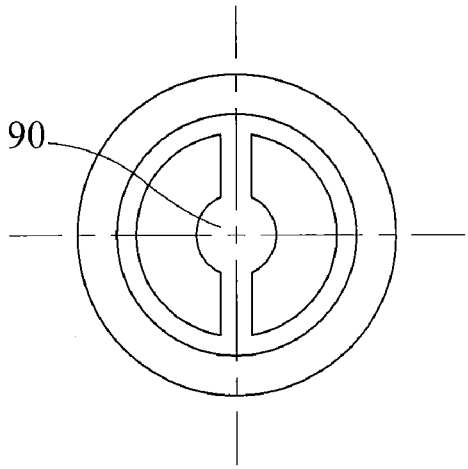
FIG. 12B is a top schematic view of an exemplary receptor designed to prevent rotation of the microtube of FIG. 12A.
Figure 13A:
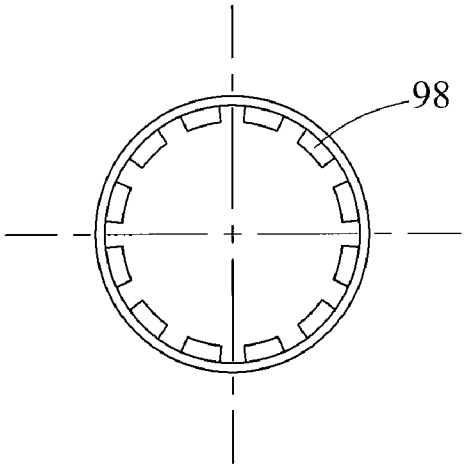
FIG. 13A is a bottom schematic view of an exemplary microtube having a ridged base section to prevent rotation.
Figure 13B:
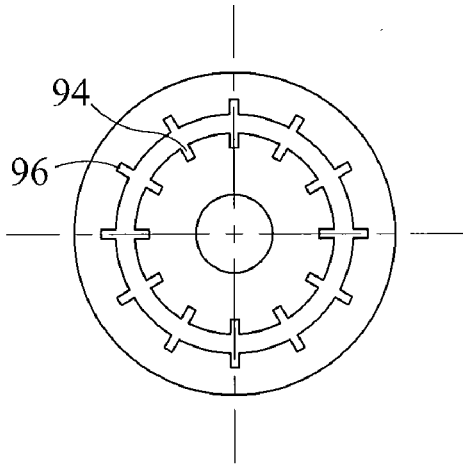
FIG. 13B is a top schematic view of an exemplary receptor designed to prevent rotation of the microtube or of FIG. 13A
Figure 14A:
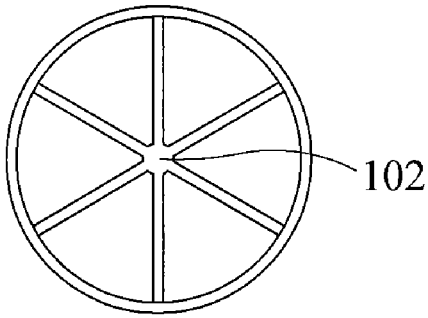
FIG. 14A is a bottom schematic view of an exemplary cryogenic vial having a star foot base to prevent rotation.
Figure 14B:
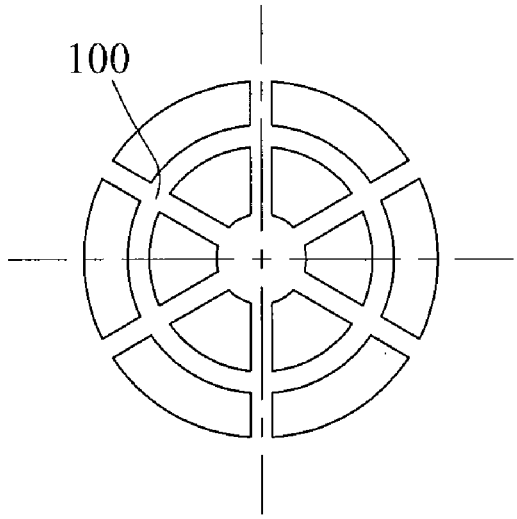
FIG. 14B is a top schematic view of an exemplary receptor designed to prevent rotation of the cryogenic vial of FIG. 14A.
Figure 15:
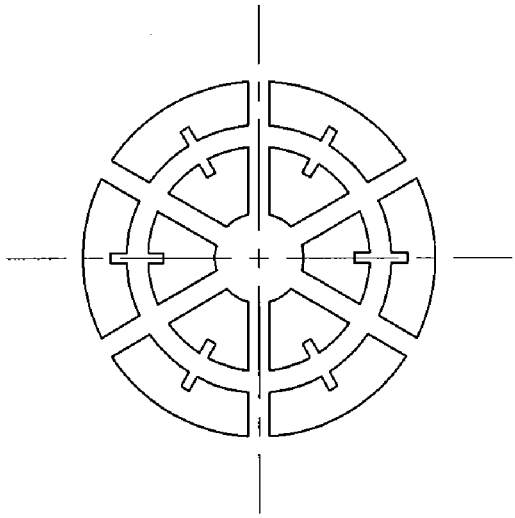
FIG. 15 is a top schematic view of an exemplary composite receptor designed to prevent rotation of the microtubes or cryogenic vials pictured in FIGS. 12A, 13A, and 14A.

In some embodiments, the holes 38 in tube container rack 22 and/or the receptors 40 on the base plate 20 may be provided with anti-rotation features that cooperate with corresponding anti-rotation or self-standing features on the tubes to prevent (or at least minimize) tubes inserted therein from rotating. Such anti-rotation features allow for easy one-handed opening or closing of the tube's screw cap 84. Such anti-rotation features may include, for example as shown in FIGS. 3 and 11B, grooves 700 (FIG. 11B) or teeth 70 (FIG. 3) in the inner peripheries of holes 38 that mate with ridges 82 on the exteriors of tubes 80 as shown in FIG. 11A, such as those manufactured by Sarstedt AG & Co., of Nübrecht, Germany, Axygen Scientific Inc, of Union City, Calif., USA, or Biosigma S.R.L., of Cona (VE), Italy. Additionally or instead, receptors 40 on base plate 20 may have one or more features, such as a groove 90 for receiving a tab 92 on the bottom of a microtubes (see FIGS. 12A and 12B) manufactured by Simport Plastics Ltd, of Beloeil, Quebec, Canada, internal grooves or teeth 94 or external grooves or teeth 96 (see FIG. 13A) that mate with internal or external ridges 98 (see FIG 13B—internal ridges shown only) as manufactured by Nalgene-Thermo Fisher Scientific of Rochester, N.Y., USA, or a periphery 100 mated to a "star foot" 102 cryogenic tubes (see FIGS. 14A and 14B), such as manufactured by Nunc GmbH & Co KG of Langenselbold, Germany and distributed by Thermo Fisher Scientific or by Greiner Bio-One North America, of Monroe, N.C., USA. All of these features may be combined to form a universal receptor 40 designed to receive any of the above configurations (see FIG. 15).

Figure 10:
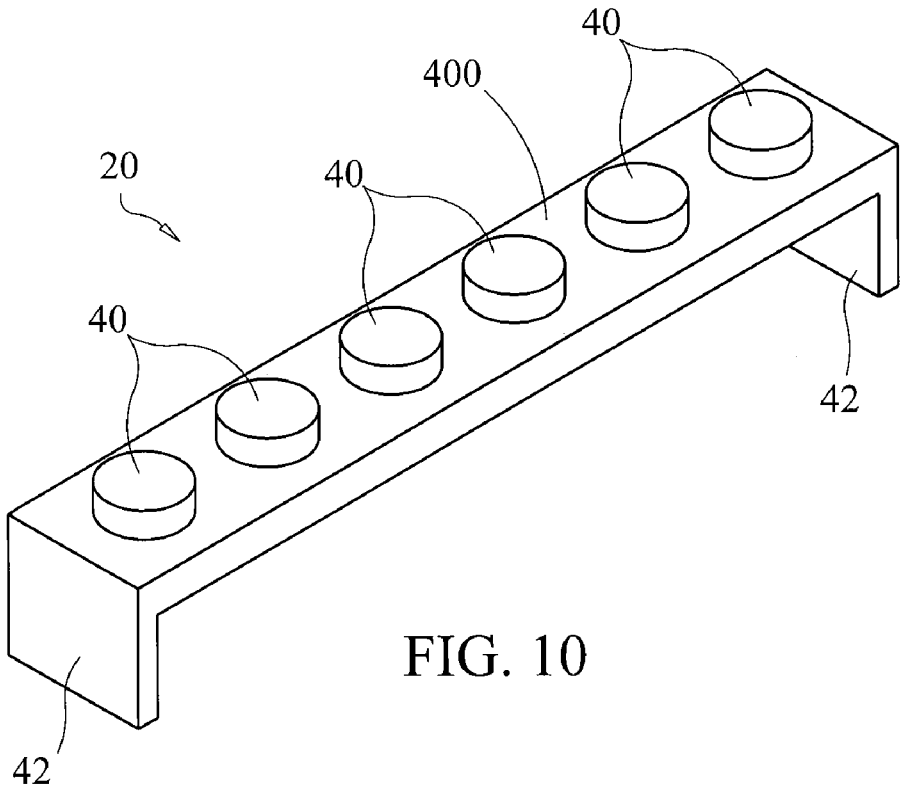
FIG. 10 is a perspective view of an exemplary base plate insert that is optionally raised to accommodate shorter microtubes or vials.
Figure 11C:
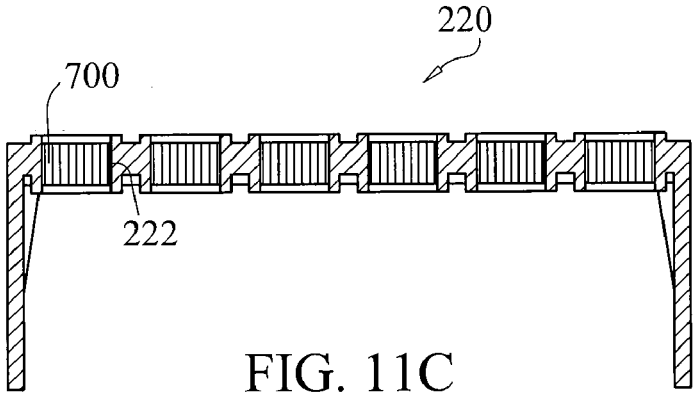
FIG. 11C is a longitudinal-sectional view of an exemplary rack of FIG. 11B along line 11C-11C with elongated grooves and expanded collars to interface with a ridged neck microtube such as the microtube of FIG. 11A.

Receptors 40 may be integral to base plate 20, and therefore a part of a single-piece molded frame 18, or may be part of a bottom insert 400, such as is shown in FIG. 10, secured, such as with an adhesive, over a base plate having a smooth interior. Thus, for ease of manufacture, a standard frame may have no receptors, and various receptor plate inserts 400 may be provided with receptors specific to particular tube bottom designs. Although shown as an insert with legs 42 in FIG. 10 for accommodating tubes smaller than the container, inserts without such legs that adhere flush to base plate 20 for providing receptors at the very bottom of the container interior may also be provided. Similarly, rack 22 may be a discrete element that may have multiple embodiments designed to interface with various tube neck designs, and may therefore be secured inside the box frame 18 with adhesive. Rack 22 is shown removed from container 10 for illustrative purposes only and is typically not removable, although designs with removable racks and/or removable receptor plate inserts may be provided. To provide additional surface area for anti-rotation features beyond the standard thickness of a hole 38 in rack 22 as shown, for example, in FIG. 3, an alternative rack embodiment 220, as shown in FIG. 11C, may comprise an elongated collar 222 having elongated grooves 700 that interface with ridges 82 of tube 80. In other designs, such as is shown in FIG. 10, the elongated collars may not have any anti-rotation features.

Figure 9:
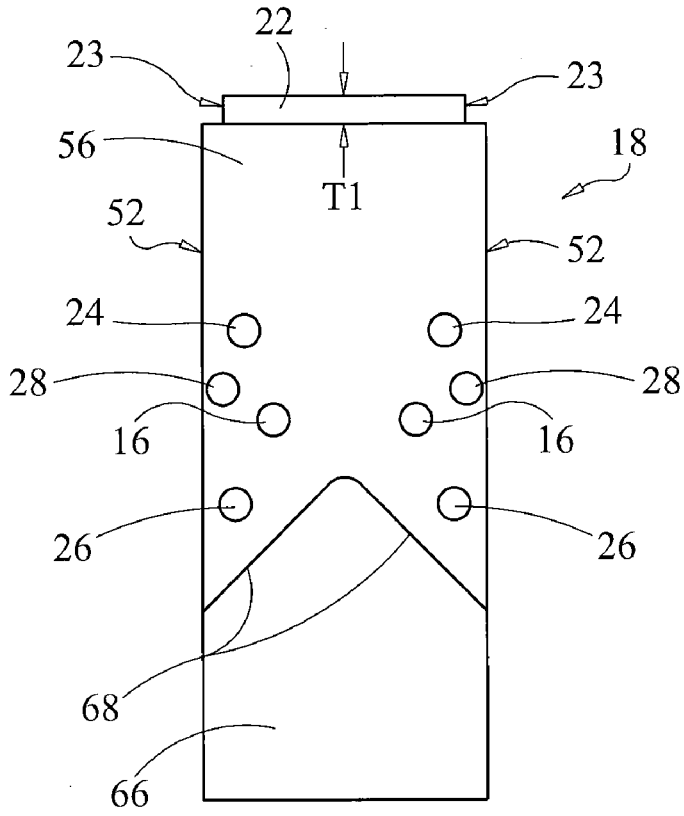
FIG. 9 is a side view of the frame of the container of FIG. 1.
Figure 11D:
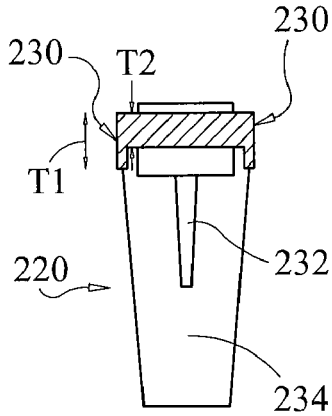
FIG. 11D is a cross-sectional view of an exemplary rack of FIG. 11B along line 11D-11D

Although the overall construction of the rack is not limited to any particular design, as shown in the cross-sectional view of FIG. 11D, rack 220 may have along its length side edge members 230 with a thickness T1 greater than the thickness T2 of the rack to prevent bowing of the rack. Rack 220 has one or more structural stiffening features 232 on each leg 234 as well. Side edge members 230 provide additional surface area for adhesion of the rack to the interior of the container, and seal any spaces between the top of the rack and the side of the container. As shown in FIG. 9, when rack 22 is inserted in frame 18, the side edges 23 of rack 22, whether thickness T1 or some greater thickness, preferably extend above the sides 52 of frame 18 to serve as stops to prevent over-rotation of the lids into the closed position. In an alternate embodiment, shown for example in FIG. 2, rack 22 may fit completely inside frame without extending above the sides 52, and sides 50 may instead have indented top portions 51 that protrude above the rack to serve as over-rotation stops for the lids.

As shown in FIG. 10, insert 220 having legs 42 may be provided to span the distance between the base plate 20 and a desired bottom height so that a single container design sized for a standard length or a longest length microtube or cryogenic vials can accommodate shorter microtubes or vials merely by using receptor plate inserts with legs of appropriate length, without having to incur substantial manufacturing cost for multiple sized containers. In the alternative, different sized containers ideally sized for specific size microtubes or cryogenic vials may be provided.

One of the primary advantages of container 10 is that it enables simple, one-handed operation by the user. Embodiments of container 10 sized to fit standard microtubes can fit in the palm of the user's hand. Raised members 60 provide the user with a thumb grip to aid in the opening of container 10. Opposing lid sections 12, 14 can be easily rotated on pins 16 into any of the three movement-resistant positions, as further described below. Finally, through the use of the locking features in receptors 40 of base plate 20 and/or holes 38 of the rack 22, the tubes can be securely held in place without rotation, to enable simple, one-handed removal or replacement of the tube's screw top lid. While the locking features do not necessarily completely prevent rotation of the microtubes, they sufficiently discourage rotation to enable a user to open the screw top lids without the tubes rotating within the container.

Container 10 may be manufactured using any material suitable for the container's intended use, but typically comprises lightweight plastics or polymers chosen to provide the desired cost and durability. For example, containers designed for single use may comprise materials that are low cost and of acceptable durability, such as, for example, without limitation, polystryrene (PS), polymethyl methacrylate (PMMA), polyvinyl chloride (PVC), or other polyacrylates, whereas containers meant for multiple uses may comprises a relatively more durable polymer such as, for example, without limitation, Acrylonitrile butadiene styrene (ABS), polypropylene (PP), or polyethylene (PE), which may also have a relatively higher cost. For containers that need to withstand extreme temperatures, such as prolonged immersion into liquid nitrogen, a suitable material of construction such as, for example, without limitation, polycarbonate, fluorinated polymer or engineering polytetrafluroethylene (PTFE) may be chosen. The invention is not limited to any particular materials of construction, however. The container may be manufactured through any standard and well-known methods for thermoplastic product manufacturing.

In one exemplary embodiment, container 10 may have slight recesses 50, 52 for receiving labels, such as to list the contents of the vials inside the container, show manufacturer details, or to indicate container ownership. These labels can be preprinted or left blank for later inscription by the user.

Figure 4:
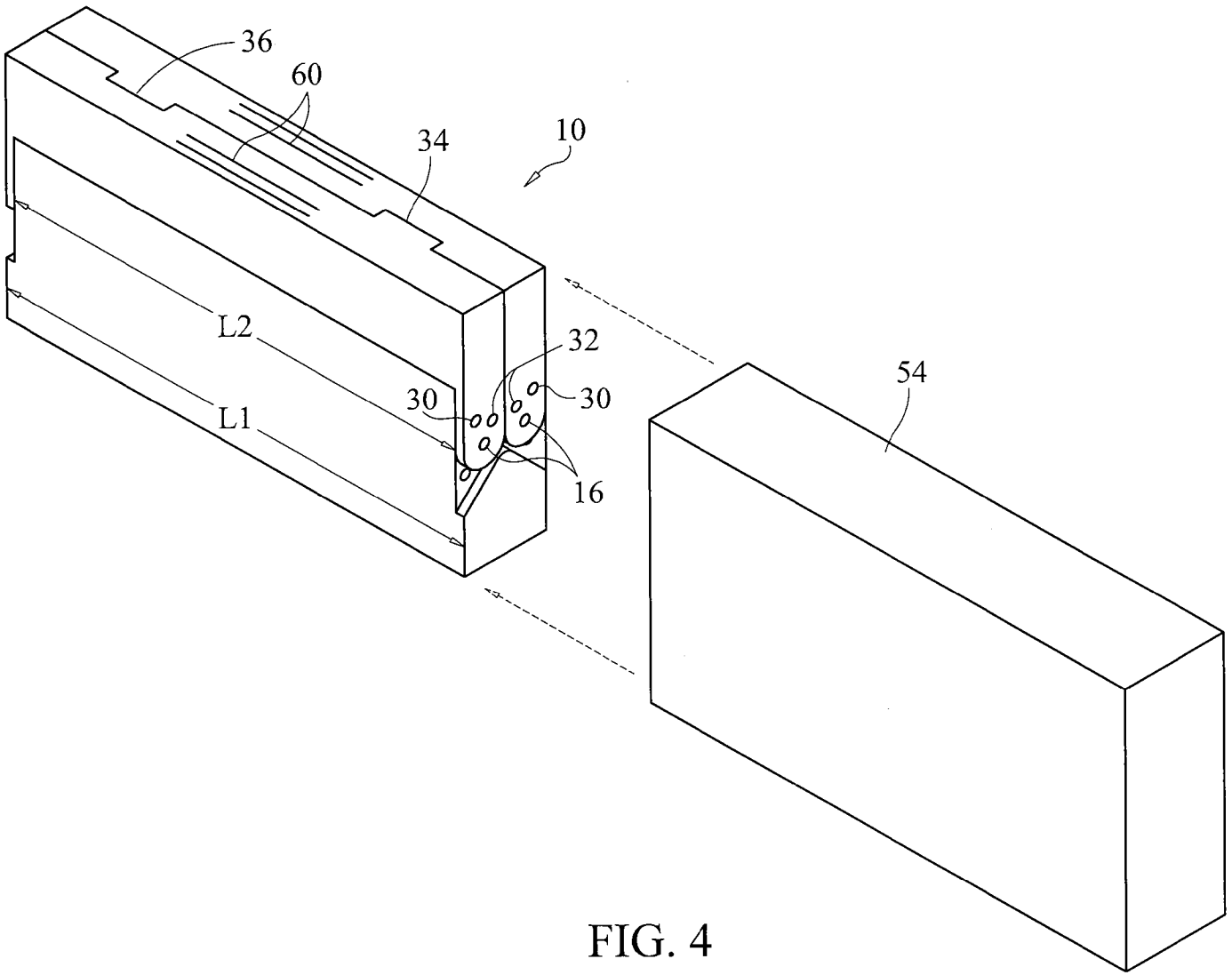
FIG. 4 is a perspective view of the sleeve for the container and the container of FIG. 1, with the lid is in the closed position.

Additionally, as shown in FIG. 4, container 10 can be fitted with a sleeve 54, such as a sleeve made of cardboard, that will snugly hold the reagent tube container and keep the container closed during shipping or transportation. The sleeve 54 may also protect the box from scratching or other damage during the shipping or transportation process. The sleeve 54 may also have pre-printed advertising or markings to identify the manufacturer or reseller of the container 10 and/or may provide space for the user-transcribed information.

Figure 2:
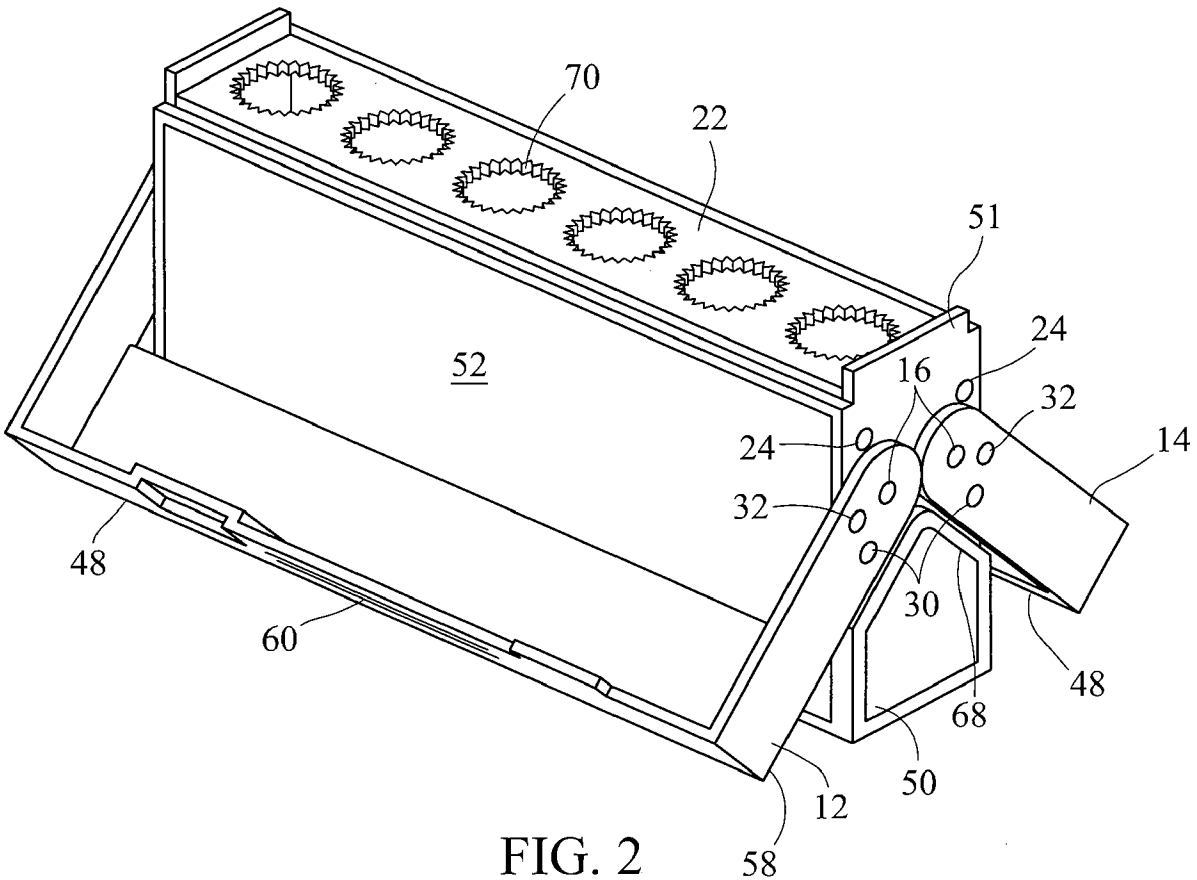
FIG. 2 is another perspective view of the exemplary container of FIG. 1 in the fully open position with the rack inserted.

FIGS. 2-4 depict the reagent tube container 10 in its three movement-resistant positions. To achieve these three positions the lid sections 12, 14 can be rotated around the axis of pins 16 and temporarily locked into position by aligning raised nubs 24, 26, 28 with the corresponding holes 30, 32 described below. The term "movement-resistant" as used herein means that the lid is temporarily locked into a position in which further rotation of the lid about pin 16 requires a greater force than is required for movement when not in one of the movement-resistant positions. Although shown with interfacing nubs and holes to provide the movement resistance, the container is not limited to any particular structural design.

Figure 5:
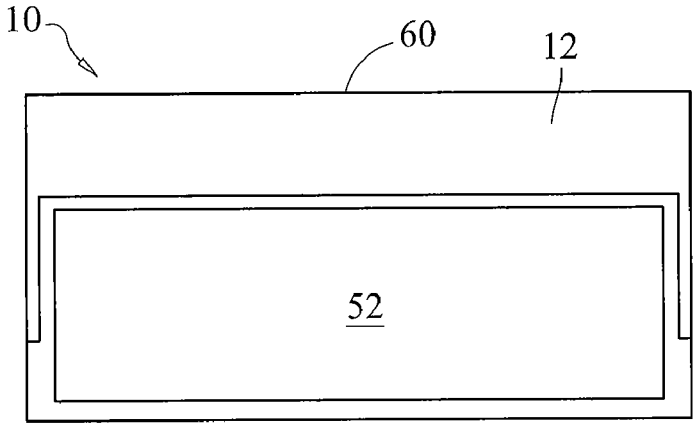
FIG. 5 is a front schematic view of the container of FIG. 1, the opposite back view being a mirror image thereof.
Figure 6:
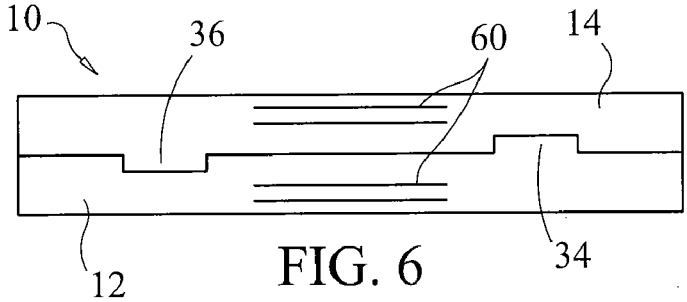
FIG. 6 is a top schematic view of the container of FIG. 1.
Figure 7:
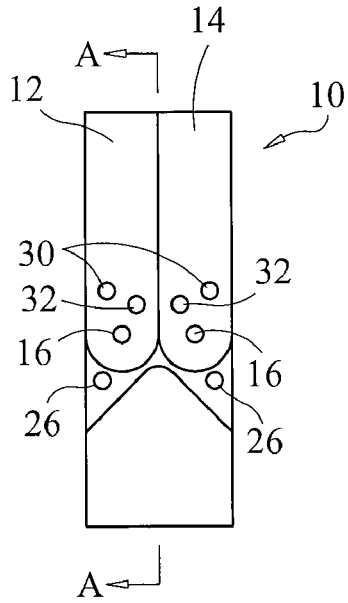
FIG. 7 is a side schematic view of the container of FIG. 1, the opposite side being a mirror image thereof.

FIG. 2 depicts the lid sections 12, 14 in a fully open position. In this fully open position, lid sections 12, 14 provide a more stable base for the reagent tube container because edges 48 lie along the same plane as base 20 of container 10. In this fully open position, holes 30 are aligned with nubs 26, such that each nub 26 penetrates hole 30 to provide sufficient support to keep the lid from inadvertently moving out of position, yet still allows the user to easily move the lid out of the fully open position when desired by exerting a relatively larger amount of force than is required when the lid is not in a movement-resistant position. The fully-open position allows for removal of the reagent tubes as well as the ability to open the reagent tubes with one hand, as discussed above. The side-to-side length L1 of the frame at the bottom of the frame is slightly larger than the side-to-side length L2 at the top of the frame, as shown in FIG. 4, because of recessed portion 56 on each side for accommodating the thickness of the lid, as illustrated in FIG. 9. Thus, the lid sections have the same side-to-side length L1 as the bottom section of the frame. In the fully open position such as is shown in FIG. 2, for example, therefore, the side edges 58 of the lid sections 12, 14 rest against ledge 68 that comprises the transition between bottom portion 66 and top recessed portion 56 of each side of the frame. In the closed position, the sides of the lid are generally flush with the sides of the frame as best shown by FIG. 5.

FIG. 3 depicts the lid sections 12, 14 locked into an intermediate position, where the front and back faces of lid sections 12, 14 are perpendicular to the front and back faces of container 10 and parallel to base plate 20. In this intermediate position, container 10 can be conveniently suspended and stored in an ice bath, allowing the samples in the reagent tubes to be maintained at lower temperatures. In this position, holes 32 are aligned with nubs 28 identified in FIGS. 7 and 9. This position also allows for removal of the reagent tubes as well as the ability to open the reagent tubes with one hand.

FIG. 4 depicts the lid sections 12, 14 in an upright and closed position. In this closed position the reagent tube container 10 can be conveniently stacked for space-saving storage or transportation. In this closed position the reagent tube container can also be stored in a carrier, such as the embodiments depicted in FIGS. 16 through 19. In the closed position, holes 30 are aligned with nubs 24 identified in FIGS. 7 and 9. To further secure the lid sections 12, 14 in the closed position, tabs 34 and 36 interface with slots 44 and 46 respectively. This interlocking mechanism allows for a more secure closure of the reagent tube container 10, but again is only movement-resistant, as a sufficient amount of force can overcome the temporarily locked position.

Although depicted with nubs 24, 26, 28 and pins 16 on the box frame 18 in FIG. 9 and the mating holes in the lid, in an alternative exemplary embodiment, nubs 24, 26, 28 and pins 16 can be placed on interior of the lid sections 12, 14 and holes 30 and 32 placed in box frame 18. This embodiment permits the outer surface of the lid sections 12, 14 to be completely smooth. In yet another alternate embodiment, holes 30 and 32 may be in the form of a recess in the material, rather than a hole that completely penetrates the material.

Figure 16:
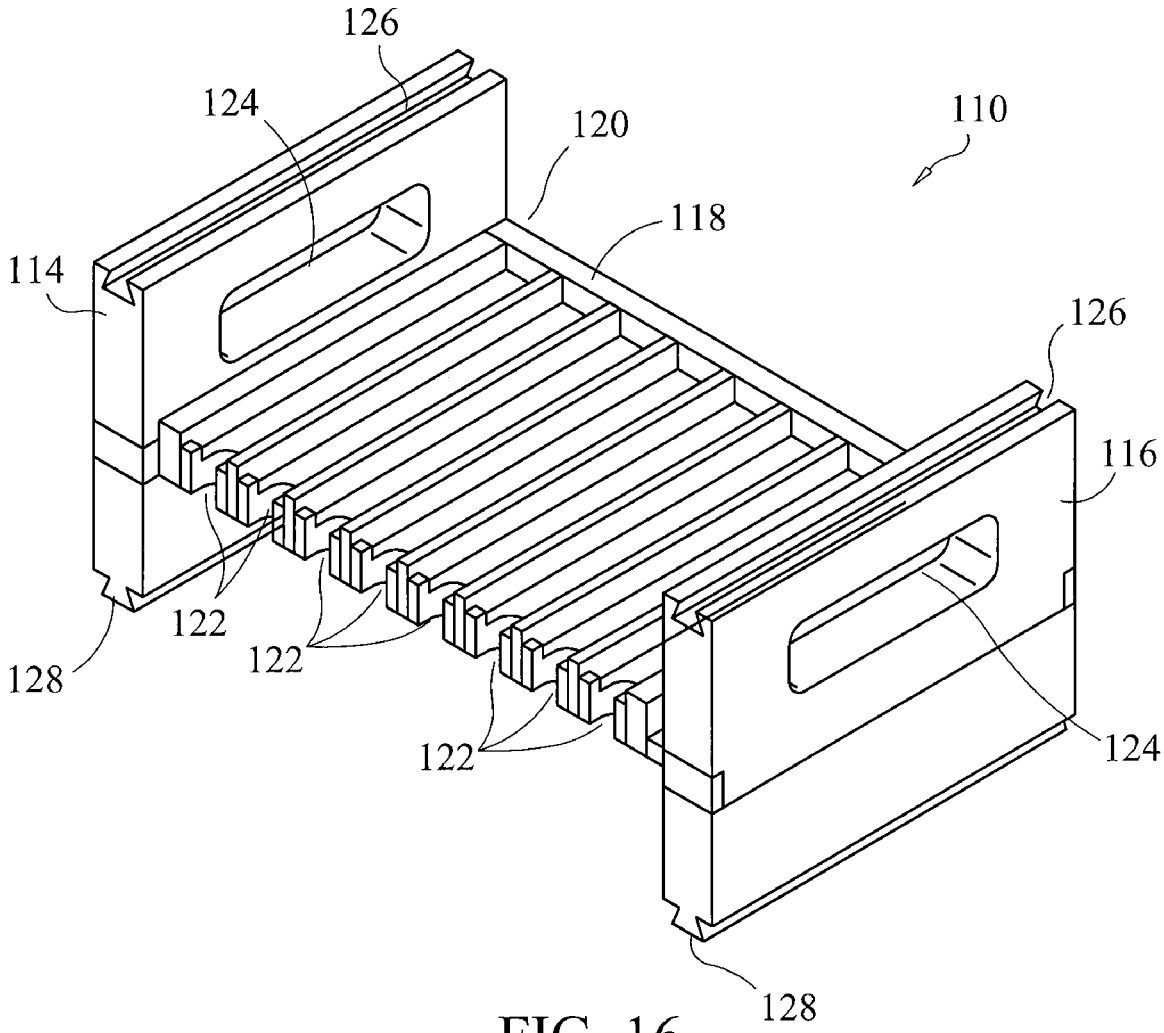
FIG. 16 is a perspective view of a first exemplary carrier embodiment for housing a plurality of the containers of FIG. 1.
Figure 17A:
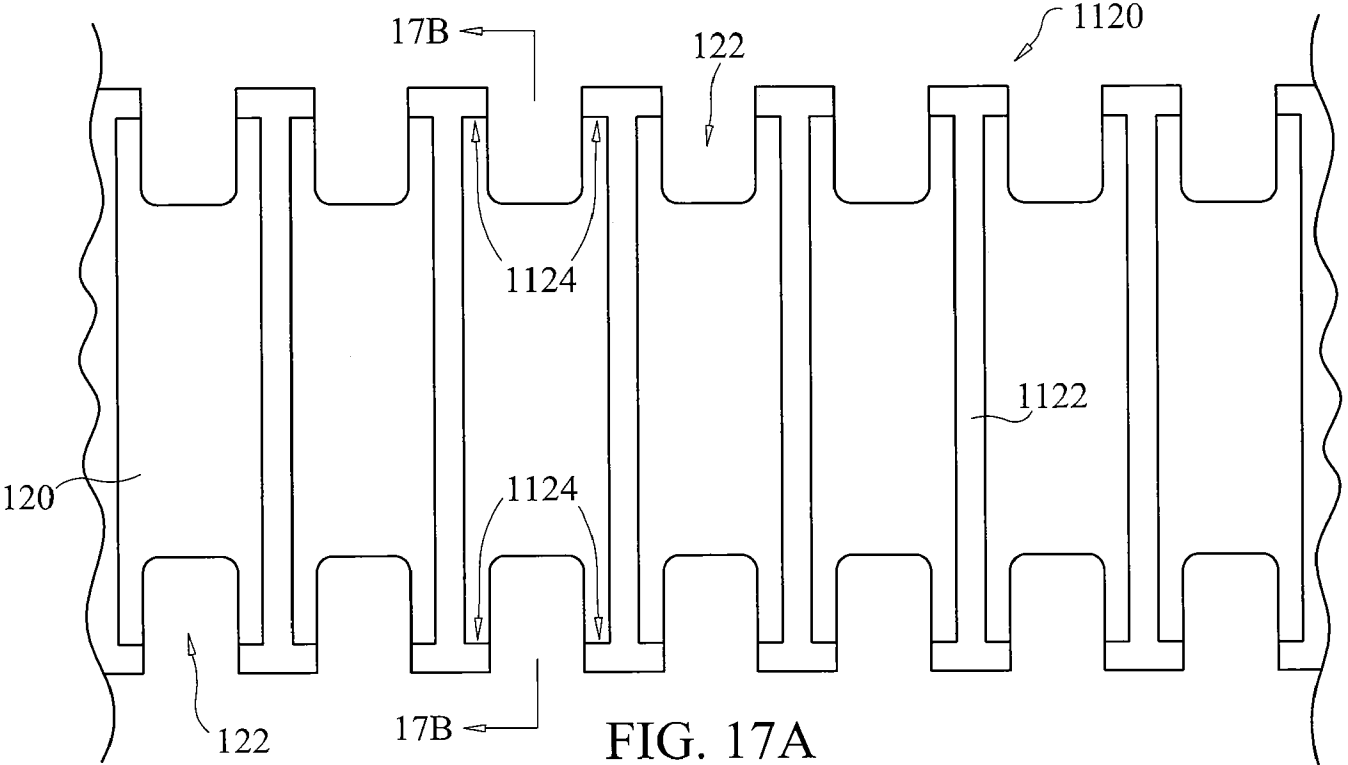
FIG. 17A is a top plan view of a portion of a base plate for an alternate carrier embodiment.
Figure 17B:
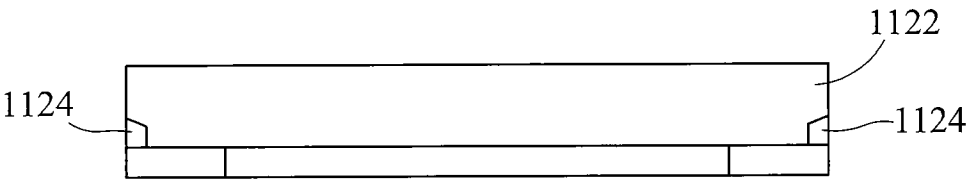
FIG. 17B is a cross-sectional view of the base plate of FIG. 17A, taken along line 17B-17B.
Figure 18:
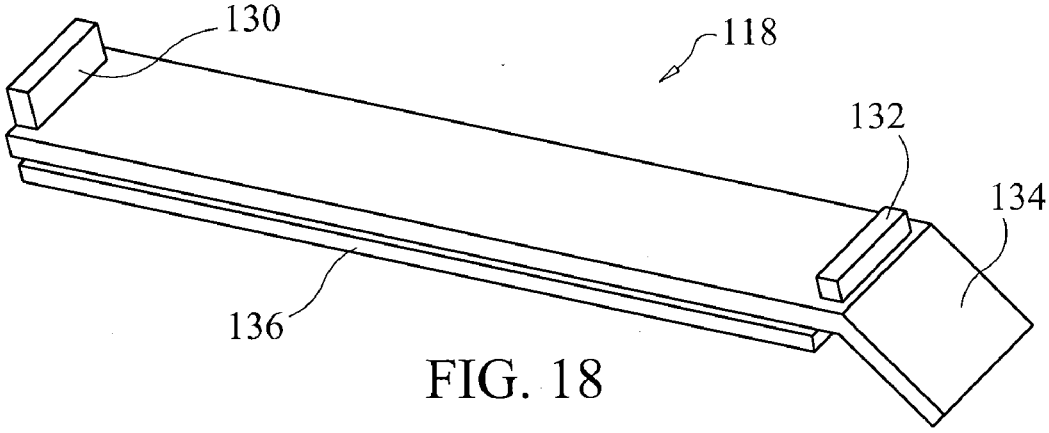
FIG. 18 is a perspective view of an exemplary slide for housing a container in the carrier embodiment of FIG. 19.

FIG. 16 shows a top perspective view of one embodiment and FIG. 17A shows a top plan view of a base plate for a second embodiment of a carrier 110 designed to hold a plurality of containers 10. Carrier 110 comprises carrier base plate 112 and two side supports 114, 116. The carrier embodiment shown in FIG. 16 has eight sections 118 adapted to hold eight containers 10. A carrier of the present invention may have more or fewer sections, however, and is not limited to holding any particular number of containers. Each of the sections 118 of the carrier base plate 112 is equipped with a back wall 120 which keeps containers 10 flush with the front of the reagent container carrier 110. In the exemplary embodiment shown in FIG. 16, the front of the carrier's base plate 112 has a plurality of cutouts or indents 122 at the front of each of the sections 118. In an alternate embodiment, shown in FIG. 17A and FIG. 17B, both the front and back of base plate 1120 have such cutouts 122. These cutouts or indents 122 allow for simple removal of the reagent tube containers 10 when stored in the multiple stacked carriers 110 by allowing a user's finger access to the underside of the container to push the container 10 up to easily slide it out of the carrier. As best illustrated in FIGS. 17A and 17B, the carrier base plate 1120 may have a plurality of dividers 1122 and a plurality of front and back corners 1124 to hold the container in place. Thus, a user must merely push the container up far enough to clear the height of the corners 1124, which is typically less than the height of the dividers 1122 between the sections. Base plate 112 may be identical to base plate 1120, except for the absence of indents in the back, and the presence of the back walls 120.

Side supports 114, 116 contain openings 124 that can be used as handles to aid in the movement of the carrier 110. Additionally, these openings reduce the amount of material needed for construction, thereby by saving weight for easier carrier movement. These openings also allow for a reduction in manufacturing costs by cutting back on the amount of material used without sacrificing stability and durability. Side supports 114, 116 also contain angled slots 126 in the top that correspond to angled feet 128 on the bottom thereof. The corresponding interaction between feet 128 and slots 126 allow for the carriers to be connected together by sliding carriers on top of one another (not shown). This aspect allows multiple carriers to be securely moved or to have multiple carriers securely stacked without a fear of the carriers toppling. Side supports 114, 116 are sized such that there is suitable space between the bottom of the carrier and any surface on which the carrier rests so that a user can easily insert a finger below the desired container to assist in removal from the carrier. Similarly, when two or more carriers are stacked, the sizing of the side supports provides a suitable amount of space between the bottom of an uppermost carrier and the tops of the containers in a lowermost carrier to permit insertion of the user's finger underneath the containers in the uppermost carrier.

Figure 19:
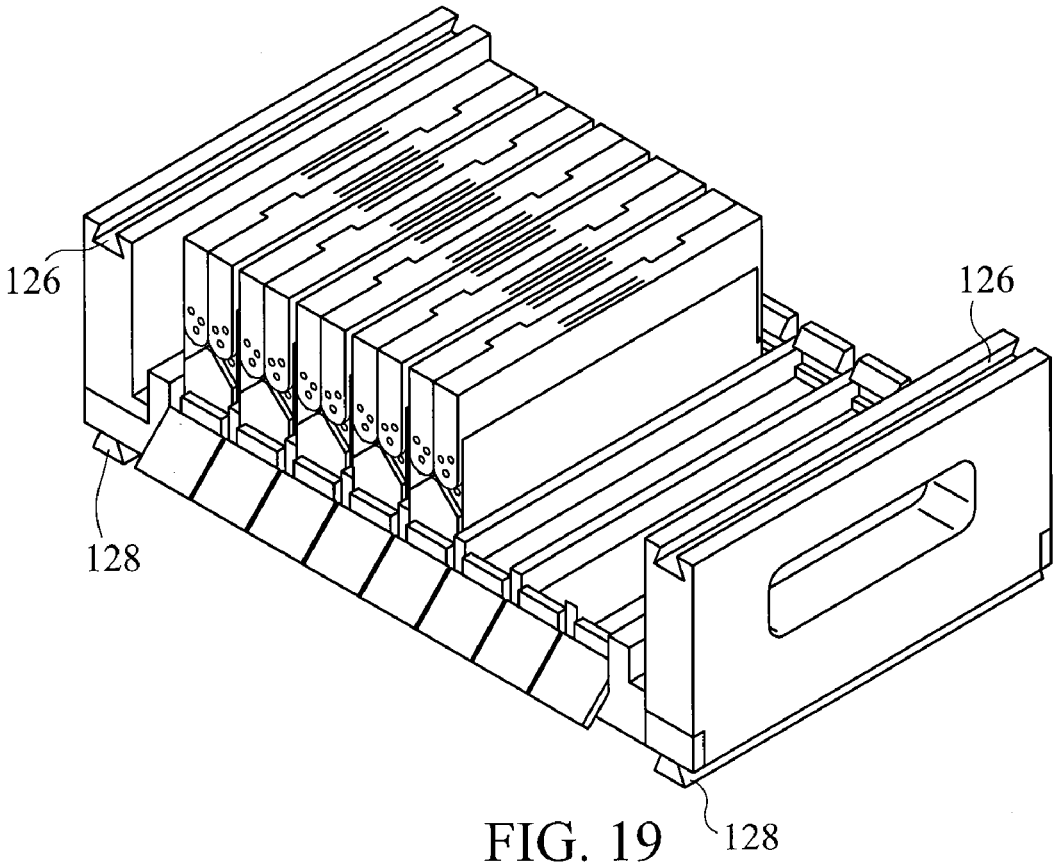
FIG. 19 is a perspective view of an assembled second carrier embodiment, housing multiple containers of FIG. 1.

FIG. 19 is a perspective view of an alternate carrier design 1100 having a plurality of removable slides 118. Each slide is designed to snugly hold one container between the rear support 130 and the front support 132. Slide 118 and container 10 can then be placed on carrier 1100. Slide 118 contains grooves 136 on opposite sides that interface with mating tongues (not shown) on carrier 1100 to facilitate sliding in and out along a desired path. In an alternative embodiment (not shown), opposing tongues may be located on the slide and mating groove located on the carrier. Pull tab 134 hangs over the front of the carrier 1100 and can be used to pull the slide 118 and the container 10 from the carrier 1100 or to push the slide 118 and the container 10 into the carrier 1100. Much like container 110, container 1100 has angled feet 128 and angled slots 126 that allow for multiple carriers 1100 to be stacked. Because carrier 1100 utilizes the slide 118 and pull tab 134, little to no space is needed between the stacked carriers, thereby saving vertical storage space.

While containers 10 may be of any size and may be suitable for holding any number of elongated objects, a preferred embodiment is for holding a number of microtubes or vials. The containers may be provided empty, without tubes, provided with empty tubes in them, or provided with tubes filled with, for example, reagents, Containers 10 may be particularly well suited for housing a predetermined group of microtubes holding reagents necessary to perform a specific function. Thus, for example, container 10 may be provided as part of a kit for carrying out a specific procedure, in which the container contains tubes of all of the necessary reagents in necessary quantities to perform the procedure. The kit may contain elements in addition to tubes of reagents, such as instructions, tools, or the like.

What is claimed:

1. A container for holding a plurality of microtubes or vials, the container comprising:

a frame having a base, front and back faces, and sides;

a pair of rotatable opposing lid sections, each lid section having an edge between a top portion of the lid section and a face portion of the lid section, each lid section pivotally attached to a side of the frame, the container having a movement-resistant fully open position, a movement-resistant closed position in which the lid sections cooperate with one another to provide a completely enclosed container, and a movement-resistant intermediate position between the open position and the closed position in which the lid section faces are perpendicular to the front and back faces of the frame;

a rack mounted within the frame, the rack comprising a plurality of holes or collars, each hole or collar sized to receive an intermediate portion of the microtubes or vials;

one or more microtubes or vials contained within respective ones of the plurality of holes or collars of the rack; and a plurality of detent mechanisms provided on at least one of the frame and the lid sections, the detent mechanisms positioned to maintain the lid sections in the movement-resistant fully open position, the movement-resistant closed position, and the movement-resistant intermediate position.

2. The container of claim 1, further comprising a plurality of bottom receptors in an interior lower portion of the container each for receiving a bottom portion of one of the microtubes or vials.

3. The container of claim 1, wherein the container further comprises one or more anti-rotation features for cooperating with features of the microtubes or vials to discourage rotation of the elongated objects when housed in the container.

4. The container of claim 3, wherein the one or more anti-rotation features comprise a plurality of notches or grooves in the holes or collar of the rack, the plurality of notches or grooves sized and spaced to cooperate with ridges on an exterior of the microtubes or vials.

5. The container of claim 3, wherein the container further comprises a plurality of bottom receptors in an interior lower portion of the container each for receiving a bottom portion of one of the elongated objects, and the one or more anti-rotation features comprises one or more grooves or notches in each of the plurality of bottom receptors adapted to mate with tabs or ridges on the bottom portion of one of the microtubes or vials.

6. A container designed to hold a plurality of microtubes or vials, the container comprising:

a frame having a base, front and back faces, and sides;

a pair of rotatable opposing lid sections each having a face, each lid section attached to a side of the frame, the container having a movement-resistant fully open position, a movement-resistant closed position in which the lid sections cooperate with one another to provide providing a completely enclosed container, and a movement-resistant intermediate position between the open position and the closed position in which the lid section faces are perpendicular to the front and back faces of the frame, the lid having a resistance to closure when in the fully open position, a resistance to opening when in the closed position, and a resistance to closure or opening when in the movement-resistant intermediate position;

a rack mounted within the frame, the rack comprising a plurality of holes or collars, each hole or collar sized to receive an intermediate portion of the microtubes or vials;

one or more microtubes or vials contained within respective ones of the plurality of holes or collars of the rack; and a plurality of detent mechanisms provided on at least one of the frame and the lid sections, the detent mechanisms positioned to maintain the lid sections in the movement-resistant fully open position, the movement-resistant closed position, and the movement-resistant intermediate position.

7. The container of claim 1, wherein the container is sized to fit within a user's hand and the lid sections are configured to be moved from the movement-resistant closed position to the movement-resistant fully open position by the user using a single hand.

8. The container of claim 1, wherein the container has outer sides and faces that are smooth except for a thumb grip on a top surface of each lid for aiding one-handed use of the container.

9. A system to store a plurality of microtubes or vials, the system comprising:

one or more containers of claim 1; and a carrier for storing one or more containers, the carrier comprising a base, opposite side supports, and a plurality of container-holding sections each sized to accommodate one of the containers.

10. The system of claim 9, wherein the carrier comprises one or more features for enabling one-hand removal of the containers from the carrier.

11. The system of claim 10, wherein the one-hand-removal feature comprises one or more sliders that interfaces with the base, each slider adapted for housing a container and adapted to slide out from the base to enable removal of the container from the slider.

12. The system of claim 10, wherein the one-hand-removal feature comprises a plurality of indentations or cutouts in the base of the carrier that each permit a user's finger access to an underside of a respective container.

13. The system of claim 9, wherein each side support of the carrier has a top and a bottom, a slot on the top of the side support, and a foot on the bottom of the side support, the foot and slot sized such that when an upper carrier is stacked upon a lower carrier, the foot from the upper carrier interlocks with the slot of the lower carrier.

14. A system to store a plurality of microtubes or vials, the system comprising a carrier configured to receive one or more containers of claim 1, the carrier comprising a base, opposite side supports, and a plurality of container-holding sections each sized to accommodate one of the containers in the closed configuration, the carrier comprising a plurality of indentations or cutouts in the base of the carrier that each permit a user's finger access to an underside of a respective container for enabling one-hand removal of the containers from the carrier.

15. The container of claim 1, wherein the one or more microtubes or vials are empty.

16. The container of claim 1, wherein at least one microtube or vial contains a substance.

17. The container of claim 16, wherein the substance comprises a reagent.

18. The container of claim 17, wherein the container comprises a kit for performing a procedure that requires a sufficient amount of one or more substances to perform the procedure, in which the container comprises one or more microtubes or vials collectively containing the sufficient amount of all of the one or more substances required to perform the procedure.

19. A container designed to hold a plurality of microtubes or vials and sized to fit in a user's hand, the container comprising:

a frame having a base, front and back faces, and sides;

a pair of rotatable opposing lid sections each having a face, each lid section attached to a side of the frame, the container having a movement-resistant fully open position, a movement-resistant closed position in which the lid sections provide a completely enclosed container, and a movement-resistant intermediate position between the open and closed positions in which the faces of the lid sections are perpendicular to the front and back faces of the frame, the lid sections movable between the closed, intermediate, and open positions by the user via one-handed operation the lid having a resistance to closure when in the fully open position, a resistance to opening when in the closed position, and a resistance to closure or opening when in the movement-resistant intermediate position;

a rack mounted within the frame, the rack comprising a plurality of holes or collars, each hole or collar sized to receive an intermediate portion of the microtubes or vials;

a plurality of bottom receptors in an interior base portion of the frame for receiving a bottom portion of the microtubes or vials;

one or more anti-rotation features in the rack, in the bottom receptors, or both, for cooperating with features of the microtubes or vials to discourage rotation of the microtubes or vials when housed in the container;

one or more microtubes or vials contained within respective ones of the plurality of holes or collars of the rack; and a plurality of detent mechanisms provided on at least one of the frame and the lid sections, the detent mechanisms positioned to maintain the lid sections in the movement-resistant fully open position, the movement-resistant closed position, and the movement-resistant intermediate position.

20. A carrier and container system for storage of microtubes or vials, the system comprising:

one or more containers of claim 19;

a carrier for storing one or more containers, the carrier comprising a base, opposite sides, and a plurality of container-holding sections each sized to accommodate one of the containers, the base comprising a plurality of indentations or cutouts sized to permit a user's finger access to an underside of a respective container for one-hand removal of the containers from the carrier, each side support having a top and a bottom, a slot on the top of the side support and a foot on the bottom of the side support, the foot and slot sized such that when an upper carrier is stacked upon a lower carrier, the foot from the upper carrier interlocks with the slot of the lower carrier.

21. The container of claim 19, wherein at least one microtube or vial contains a substance.

22. The container of claim 21, wherein the container comprises a kit for performing a procedure that requires a sufficient amount of one or more substances to perform the procedure, in which the container comprises one or more microtubes or vials collectively containing the sufficient amount of all the one or more substances required to perform the procedure.

23. The container of claim 19, comprising universal anti-rotation features in the bottom receptors designed to interface with a plurality of microtube or vial bottom designs.

24. The container of claim 1, in which the base has a structure configured to permit the container in the closed position to rest on a planar surface in a standing position supported by the base alone.

25. The system of claim 14, wherein each side support has a top and a bottom, a slot on the top of the side support, and a foot on the bottom of the side support, the foot and slot sized such that when an upper carrier is stacked upon a lower carrier, the foot from the upper carrier interlocks with the slot of the lower carrier in a sliding engagement therewith.

26. The container of claim 1, in which the lid sections are configured to cooperate with the base to stabilize the container in a stabilized standing configuration with the edges of the lid sections and the base in contact with a common planar surface not attached to the container, in which the lid face sections define an acute angle relative to the faces of the frame.

27. The container of claim 19, in which the lid sections are configured to cooperate with the base to stabilize the container in a stabilized standing configuration with the edges of the lid sections and the base in contact with a common planar surface not attached to the container, in which the lid face sections define an acute angle relative to the faces of the frame.

* * * * *